US008810387B2

(12) United States Patent
Hall et al.

(10) Patent No.: US 8,810,387 B2
(45) Date of Patent: Aug. 19, 2014

(54) METHOD AND APPARATUS FOR THE INSPECTION, MAINTENANCE AND TESTING OF ALARM SAFETY SYSTEMS

(71) Applicant: Apollo America, Pontiac, MI (US)

(72) Inventors: David L. Hall, Pontiac, MI (US); Peter Stouffer, Holly, MI (US)

(73) Assignee: Apollo America Inc., Auburn Hills, MI (US)

( * ) Notice: Subject to any disclaimer, the term of this patent is extended or adjusted under 35 U.S.C. 154(b) by 0 days.

(21) Appl. No.: 13/662,085

(22) Filed: Oct. 26, 2012

(65) Prior Publication Data

US 2013/0106600 A1 May 2, 2013

Related U.S. Application Data

(60) Provisional application No. 61/554,714, filed on Nov. 2, 2011.

(51) Int. Cl.
*G08B 29/00* (2006.01)
*G08B 29/12* (2006.01)

(52) U.S. Cl.
CPC ..... *G08B 29/12* (2013.01)
USPC ..... 340/514; 340/6.1; 340/291; 340/292; 340/506; 340/507; 340/508; 340/515; 340/516; 340/517

(58) Field of Classification Search
USPC ..... 340/514, 6.1, 291–292, 506–508, 340/515–517
See application file for complete search history.

(56) References Cited

U.S. PATENT DOCUMENTS

| | | | | |
|---|---|---|---|---|
| 5,594,417 | A * | 1/1997 | Morita | 340/506 |
| 5,705,979 | A * | 1/1998 | Fierro et al. | 340/517 |
| 6,313,744 | B1 * | 11/2001 | Capowski et al. | 340/514 |
| 6,362,743 | B1 * | 3/2002 | Tanguay et al. | 340/630 |
| 6,741,181 | B2 | 5/2004 | Skaggs | |
| 7,019,646 | B1 * | 3/2006 | Woodard et al. | 340/539.26 |
| 7,204,522 | B2 | 4/2007 | Hall et al. | |
| 8,015,873 | B2 | 9/2011 | Hall et al. | |
| 8,141,422 | B2 | 3/2012 | Hall et al. | |
| 8,266,974 | B2 | 9/2012 | Hall et al. | |
| 2003/0128114 | A1 * | 7/2003 | Quigley | 340/506 |
| 2004/0021576 | A1 * | 2/2004 | Scott et al. | 340/628 |
| 2004/0217857 | A1 * | 11/2004 | Lennartz et al. | 340/514 |
| 2005/0146427 | A1 * | 7/2005 | Mazzone | 340/521 |
| 2005/0200472 | A1 * | 9/2005 | Curran et al. | 340/506 |
| 2006/0082464 | A1 * | 4/2006 | Andres et al. | 340/660 |
| 2006/0220891 | A1 * | 10/2006 | Barrett et al. | 340/636.1 |
| 2006/0226972 | A1 * | 10/2006 | Smith | 340/539.1 |
| 2007/0001860 | A1 * | 1/2007 | Frost-Gaskin | 340/577 |
| 2007/0176766 | A1 * | 8/2007 | Cheng | 340/527 |
| 2007/0241876 | A1 * | 10/2007 | Johnston et al. | 340/506 |
| 2008/0084291 | A1 * | 4/2008 | Campion et al. | 340/514 |

(Continued)

*Primary Examiner* — Benjamin C Lee
*Assistant Examiner* — Quang D Pham
(74) *Attorney, Agent, or Firm* — Gifford, Krass, Sprinkle, Anderson & Citkowski, P.C.

(57) ABSTRACT

A safety system receives inputs from safety related input devices such as smoke detectors and the like and provides triggering outputs to notification appliances such as bells and the like and/or safety functions such as door releases. To facilitate testing of the input devices the system incorporates a timer operative to disconnect the output devices for a period of time during which testing may be achieved, automatically reconnects the output devices at the end of the time, records the number of triggering outputs received at the outputs during that period.

11 Claims, 3 Drawing Sheets

(56) References Cited

U.S. PATENT DOCUMENTS

2008/0224847 A1* 9/2008 Pepper ..... 340/514
2010/0073175 A1* 3/2010 Lontka ..... 340/635
2010/0302045 A1* 12/2010 Foster ..... 340/577
2010/0315224 A1* 12/2010 Orsini et al. ..... 340/516
2011/0018705 A1* 1/2011 Egawa et al. ..... 340/539.1
2011/0187541 A1* 8/2011 Noguchi ..... 340/628
2011/0247837 A1* 10/2011 Lee ..... 169/37

* cited by examiner

METHOD AND APPARATUS FOR THE INSPECTION, MAINTENANCE AND TESTING OF ALARM SAFETY SYSTEMS

CROSS REFERENCE TO RELATED APPLICATIONS

This application claims priority of U.S. Provisional Application 61/554,714 filed Nov. 2, 2011, the contents of which are incorporated herein by reference.

FIELD OF THE INVENTION

The present invention in general relates to safety systems for use in buildings which employ sensors for dangerous conditions to activate appropriate alarm devices and the like, and in particular to a safety system incorporating features which facilitate system installation, maintenance and testing and a method of operation of such a safety system.

BACKGROUND OF THE INVENTION

The present invention has utility in the installation, maintenance and testing of a safety system. Such systems are found throughout apartment buildings, commercial spaces, and industrial, institutional, health and educational settings and the like. Typical activating devices include such sensors as smoke detectors, heat detectors, manual pull stations, carbon monoxide detectors, radiation detectors, seismic sensors, and other hazardous gases or conditions that might occur in a given setting.

Present, commercially available safety systems have multiple sensors that pass an activation signal to an alarm panel that uses the signal to activate an alarm or notification appliance such as a siren, bell, strobe light, or recorded instructions. Alternatively, or in conjunction with activation of notification appliances, the panel of a present system also activates responsive safety functions. Representative of these safety functions are door releases, smoke dampers, lock controls HVAC shutdowns, elevator recall, sprinkler systems, chemical fire suppression agents, or the like.

During installation, maintenance and subsequent testing of a present safety system, each activating device is required to be tested from start to finish ("end to end") to the satisfaction of safety authorities, typically local authority having jurisdiction, that a given activating device in fact activates each and every notification appliance and safety function the activating device is intended to operate. By way of example, if an internal door is released and closed by a safety function, the door must be opened before a smoke detector is tested. Upon testing the smoke detector, the installer must verify that the door closed in response to smoke detector activation. For each additional detector to be tested, the door must be reopened and verified to close again. If there are a substantial number of activating devices and/or a substantial number of safety functions, the number of testing combinations grows exponentially.

Live testing of the proper operation of a present safety system by initiating a signal from a sensor and checking the activation of the appropriate notification device and/or safety function is often disturbing to occupants of the building housing the system and to avoid such disruptions during installation or testing installers or testers are motivated to use various short cuts and/or only test a select subset of the system or ignore this testing together—with or without a waiver.

When an installer or tester of a present system fails to test all the possible combinations and permutations of a system, regardless of complexity, a waiver is required to be obtained from safety authorities, as abbreviated testing endangers the safety of structure occupants. Alternatively, an installer or tester of a system may disconnect and test portions of the system separately. This does not meet the requirements of many safety codes and doesn't verify the proper start to finish, end to end, operation of the system in all situations. Additionally, this abbreviated test regime includes the risk that the installer or tester may forget to reconnect the output devices or may make a mistake while reconnecting the activating devices and effectively change the functionality of the overall system and/or forget to remove all temporary "by-pass/cut-off" methods. To mitigate the risk of failure to reconnect activating and/or output devices or make a mistake during reconnection, installers and testers have developed a number of clever techniques to help assure that all devices are reconnected including color-coded labels and part counts. However, none of these workarounds to complete system testing is foolproof and indeed often not code compliant.

Thus, there exists a need for a safety system that facilitates fail safe safety system installation maintenance and testing without undue disturbance of the building containing the system regardless of the complexity of the system.

SUMMARY OF THE INVENTION

The present invention is accordingly directed to a novel safety system including an installation, test and maintenance relay device that accepts one or more triggering inputs from activation devices, such as smoke detectors and like sensors, and provides them to a timing circuit that may be activated either manually or automatically to temporarily inhibit the relay device from providing outputs that energize one or more alarm signals such as bells, sirens, or the like, as well as from safety function devices such as door releases, smoke dampers, HVAC shutoff, and the like.

This delay allows testing of the activation devices during installation, inspection, periodic maintenance, or troubleshooting without activating the alarm signals or safety function devices. After the time delay expires, the system automatically returns to normal operation, precluding an accidental inactivation of the system after conclusion of testing. It also provides an additional signal that the device is in the installation, maintenance and testing mode.

During the test period, while the outputs to the notification and safety function devices are deactivated, the installation, testing and maintenance device records the number of triggering signals that are received from the system. This allows the person testing the system during the test period to generate a given number of alarm condition outputs from the inputs and check to see if the number of trigger signals received at the output device coincides with the number of signals sent to check the integrity of the circuit between those end to end points.

To test a system employing the present invention, typically involves two steps. One, testing the operation of the alarm and safety function devices or some subset of these devices. This may be done during a time that the building is unoccupied to avoid disturbing the occupants. Second, actuating the timer and relay that disconnect the input generated signals from the alarm and safety function devices and generating alarm triggering signals from each of the inputs and counting the triggering signals that reach the maintenance mode relay to insure the integrity of the communication pathways between the inputs and the maintenance mode relay. This step may be performed while the building is occupied without disturbing the occupants.

The present invention thus allows testing and validation of a system's safety functions and alarm or notification devices without disturbing the building's occupants. It additionally provides the tester with a positive feedback of the number of system requested activations that occurred during the test mode and verifies all pathways end to end. This number of "hits" can be further verified by the tester to account for every possible operational scenario that a tester activates, and optionally be documented for validation. The systems of the present invention can be hardwired, wireless and/or use a combination of signal transmission technologies. Systems, circuits and devices serviced by the present invention can range from a single one to any number.

BRIEF DESCRIPTION OF THE DRAWINGS

The present invention is further detailed with respect to the following exemplary drawings. These drawings are provided for illustrative purposes only. The invention is not intended to be limited to the specific embodiments depicted.

DETAILED DESCRIPTION OF THE INVENTION

Figure 1:
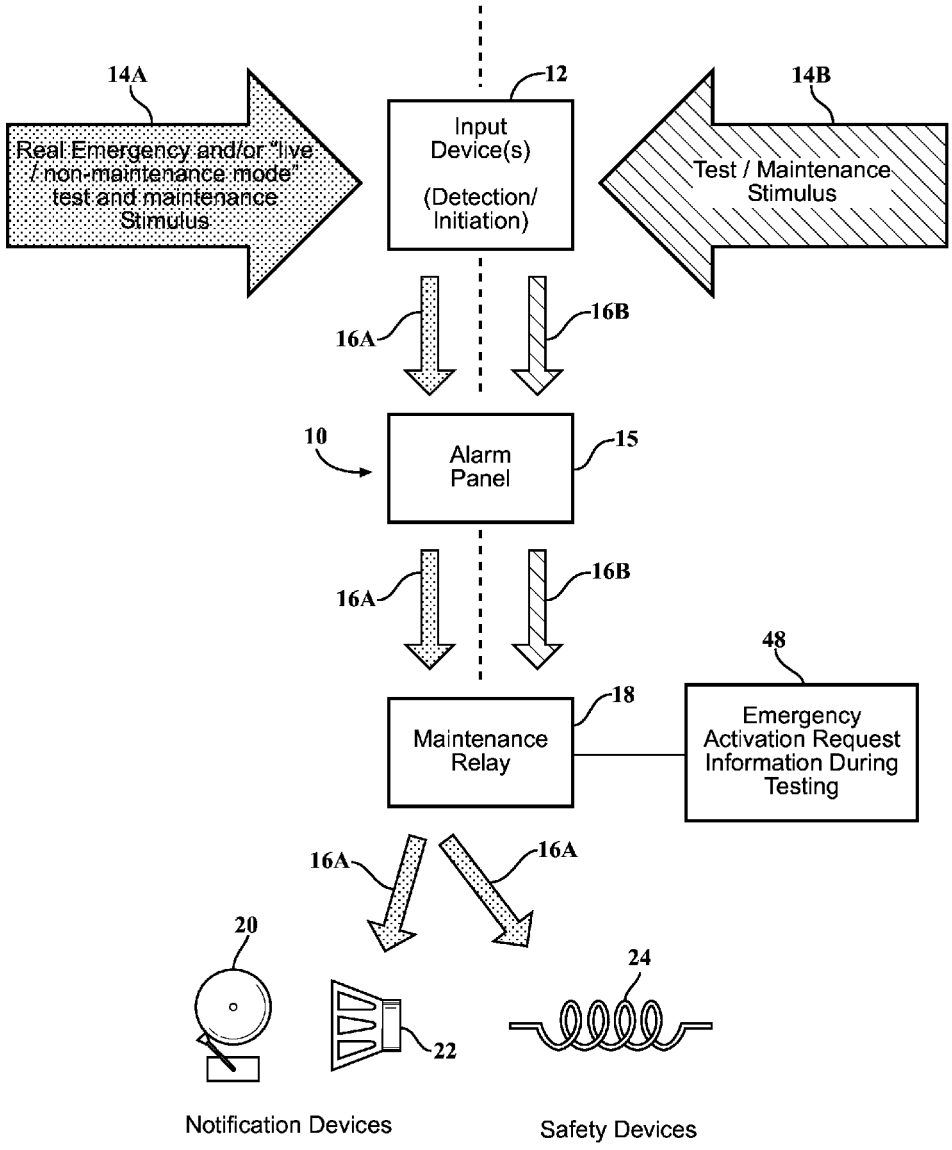
FIG. 1 is a schematic of an inventive safety system.

Referring now to FIG. 1, a schematic diagram of a preferred embodiment of the inventive system is generally indicated at 10. This system includes one or more input devices 12 for sensing dangerous conditions. The input devices include at least one of the aforementioned activating devices such as smoke detectors, Co2 detectors and the like. The input devices normally operate to provide output signals which activate alarms and the like and safety devices ("output devices") when they detect dangerous conditions indicative of a real emergency. This condition is designated 14A on FIG. 1. The system may also be placed in a test or maintenance mode wherein the input devices are activated to generate alarm output signals without activating output devices to allow the testing of the operation of the system from the input to output ends. In FIG. 1 this condition is designated 14B. The signals generated by the input devices to the balance of the system during normal, live operation, wherein an output signal is generated upon detection of a dangerous condition, are designated 16A. The signal path for the signals generated by the input device during a test or maintenance stimulus are designated 16B.

In either of these live or test modes the output signals from the input devices are communicated to an alarm panel 15. The signal paths from the input devices to the alarm panel, like the other communication paths in the system, may be hard wired, or generated wirelessly by radio, infrared signals or the like.

The alarm panel 14 accepts the signals from the input devices generated in either mode and generates outputs that are intended, during the normal mode operation to activate selected notification devices or safety devices. By way of example, an alarm signal generated by a smoke detector may be required to activate an alarm bell and open smoke dampers. Therefore, the input to the alarm panel 14 of an alarm signal from smoke detector will generate output signals from the panel which, in live operation of this system 10, will activate the alarm bells and open the smoke dampers.

The alarm panel may use separate wired circuits to activate the required output for each input device or may constitute a more flexible microprocessor based device. It will typically provide several output signals for each sensor signal it receives. These signals are provided to an installation, testing and maintenance relay 18 which is subsequently described in FIG. 2. As will be subsequently disclosed in detail, the maintenance relay may be used by personnel testing the operation of the system in accordance with the mode illustrated at 14B, without generating alarm outputs that would disturb occupants of the building in which the safety system is installed. It thus inhibits signals originating from the input devices, and translated by the alarm panel, from actuating the notification devices, such as the alarm bell 20 or the audio warning system illustrated by the speaker 22, or the safety devices 24. During live operation of the system the maintenance relay generates output signals in signal path 16A to the notification devices or the safety devices when triggered by the emergency signal from an input device relayed through the alarm panel 14.

This allows the system 10 to be tested by generating signals from the input devices to activate the notification devices 20 and 22 and the safety devices 24 when the maintenance relay 18 has not been set into the test mode, preferably when the building in which the system is installed is unoccupied. If the notification devices and safety devices operate properly, the balance of the system may be tested by initiating a time delay in a manner which will be subsequently described.

While the maintenance relay 18 is in the test mode, the various input devices 12 are actuated to generate signals that are translated by the alarm panel 15 into signals for the output devices, but these are inhibited by the maintenance relay. In this mode the tester needs to verify that the number triggering signals reaching the output devices coincides with the number of signals generated by the input device under test.

To enable this, the maintenance relay sends signals based on each triggering inputs it receives to a unit 48 which records these emergency activation signals received by the maintenance relay during testing. By way of example if a person testing this system during a time delay generated by the maintenance relay 18 causes a smoke detector to generate output signals three times during a test, the tester will check the record in the unit 48 to ensure that three trigger signals were received during that delay period. Alternatively, the unit 48 could be in communication with the tester through a personal wireless audio device or the like so that each time an emergency signal is generated by an input device the tester could ensure that a signal was received by the maintenance relay 18.

Figure 2:
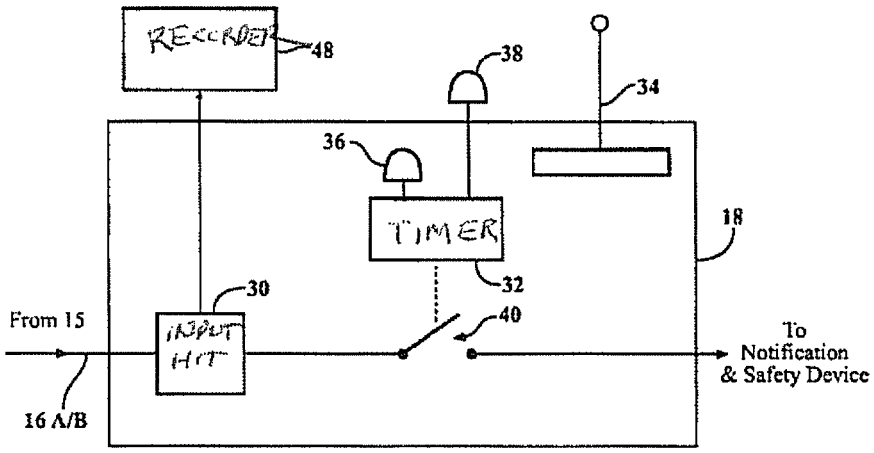
FIG. 2 is a schematic depicting relay blocks operative in an inventive safety system of FIG. 1.

FIG. 2 is a schematic diagram of the structure of the maintenance relay 18. It receives inputs on a signal path 16A/16B from the alarm panel 15. This signal path is designated as a signal line but it could be a multiconductor bundle of all of the possible outputs of the alarm panel 15 which are ultimately directed toward the notification devices and the safety devices. If it is a single conductor it may carry digital signals designating the notification devices or safety devices to be energized. Optionally these installation, maintenance and testing operations could be documented and/or archived (dated/timed) to create a permanent record of the testing.

The input signal is directed to a detector device 30 which detects a signal or a "hit" from the alarm panel 15 generated by a signal from one of the input devices 12. During the test/maintenance mode of the system these signals are sent to a recorder 48 which records the emergency activation requests received during testing. The testing mode is initiated by a timer 32 which may be actuated manually as by a push button 34, or initiated by remote signal from the test operator or an offsite location. The relay 18 may include a dial such as 36 for controlling the length of the time delay signal generated by the timer 32.

During the timing period, a signal light 38 may be energized to indicate to operators that the device is in timing mode. In the timing mode, when the timer opens, a device schematically illustrated as a single pole switch 40 interrupts the passage of signals from the output of the alarm panel to the notification devices and safety devices. If the input signal constitutes a bundle of conductors, the switch 40 would be required to open all of the conductors. Alternatively, a single pole switch 40 could be implemented with a semiconductor device or the signal path involving either a single conductor or multiple conductors could be interrupted by grounding the conductors rather than by physically interrupting them.

At the end of the time delay the system automatically returns to its normal status without requiring intervention by personnel. Similarly, in the event of relay 18 failure the system would return to the non-maintenance mode rendering it fail safe. This eliminates the possibility of a tester forgetting to return the system to its normal status at the end of the testing routine.

The signals generated by the input devices operating through the alarm panel 15 may not have the proper electrical format to energize the notification devices or the safety devices. Accordingly, it may be necessary to pass the output signals from the alarm panel through a signal conditioning device by way of example, the signal condition device may vary in voltage, polarity or wave form of the signals provided to the notification devices and safety devices.

These signal conditioning devices could be provided at each of the notification devices and safety devices themselves, thus, signals and the path 16A from the maintenance relay 18 during normal operation of the system can first pass through a signal conditioning device associated with each notification device or safety devices. Alternatively, the signal conditioning devices could be built into the maintenance relay 18 or the outputs of the alarm panel 15.

FIGS. 3A-3I depict typical forms of single conditioning blocks for the input voltage.

Figure 3A:
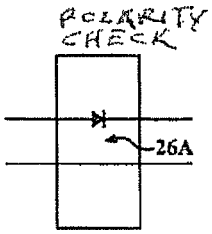
FIG. 3A-3I are schematics of various signal conditioning blocks useful with the present invention.

FIG. 3A shows a polarized signal conditioning block at 26A. The block 3A includes a diode that only responds to direct current voltages applied with a correct polarity.

Figure 3C:
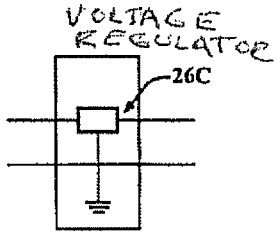
Figure 3B:
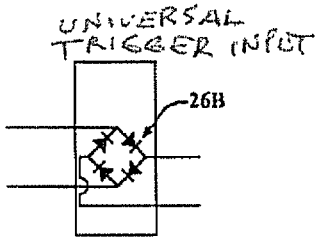

FIG. 3B depicts a bridge signal conditioning block at 26B and is particularly well suited to receive a trigger input that is either alternating current or direct current and of any polarity.

FIG. 3C depicts a voltage regulator signal conditioning block at 26C. The block 3C moderates voltage of a trigger input typically downward to a lower voltage so as to feed a relay coil at a constant voltage thereby facilitating usage of a larger range of input voltages associated with trigger input 5.

Figure 3D:
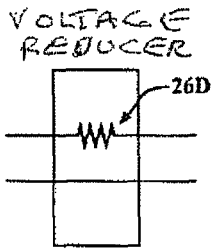

FIG. 3D shows a resistive voltage reduction signal conditioning block at 26D.

Figure 3E:
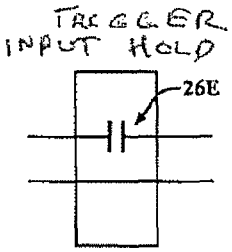

A capacitive voltage reduction signal conditioning block is shown at 26E in FIG. 3E. A common attribute of voltage reduction signal conditioning blocks 26D and 26E is that a trigger input with a high voltage is reduced to a lower voltage better suited for driving a relay coil.

FIG. 3E depicts a capacitive signal conditioning block at 26E with a capacitor across the trigger input holding the block in a closed circuit condition even if power is momentarily disrupted.

Figure 3F:
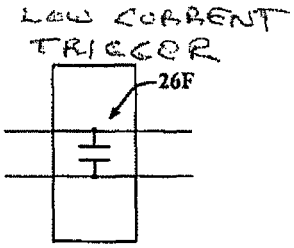
Figure 3G:
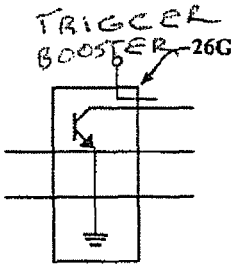

FIG. 3F depicts a low current signal conditioning block at 26F. The block 26F allows a trigger input to drive a transistor or similar circuit that in turn powers a relay coil.

Block 26 is particularly well suited to allow a low current or low voltage trigger input to control a comparatively higher current or higher voltage output. It is appreciated that an external power source is required in a low current circuit of 26G so as to boost the output in terms of current and/or voltage relative to the trigger input.

Figure 3H:
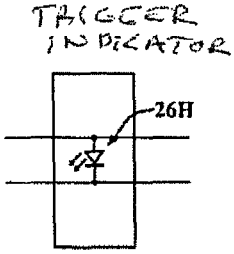

FIG. 3H depicts an indicator signal conditioning block at 26H in which a light emitting diode (LED) or similar signaling device is wired across the trigger input to indicate activation of an activating device. The indicator signal conditioning block 3H is particularly well suited to aid in troubleshooting of a system 10.

Figure 3I:
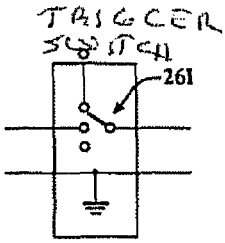

FIG. 3I depicts a control signal conditioning block at 26I. The block 3I includes a switch to provide for local control. As a result, the block 24*j* can be forced into an on position, off position, or into electrical communication with a trigger input.

The various signal conditioning block functionalities 26A-26I are readily combined to create additional functionality. Further, it is appreciated that signal conditioning block 26 is readily operated under microprocessor control to provide still additional functionalities such as timers, remote monitoring, and dynamic configurations.

The invention claimed is:

1. A safety system comprising input devices for ambient conditions operative to generate trigger signals and alarm notification output devices and safety activation output devices normally activated by the trigger signals, which facilitates system testing, the safety system further comprising:

an alarm panel for receiving trigger inputs from at least one of said input devices and operative to generate output signals communicated to said alarm notification and safety activation output devices for activating at least one alarm notification device and/or at least one safety activation device;

a temporary disconnect circuit comprising a timer that upon activation precludes the output signals by the alarm panel from being communicated to said at least one alarm notification output device and/or at least one safety activation output device for a predetermined period of time, and, after expiration of the predetermined period, restores communication of the output signals of the alarm panel to at least one alarm notification output device and/or at least one safety activation output device;

means for generating trigger signals by the input devices during said predetermined period and a recorder for recording the number of trigger signals generated by said input devices during the period of activation of said timer at the inputs to the disconnected at least one alarm notification output device and/or at least one safety activation output device to provide a test result of the integrity of said system from the input devices to the output devices based on the recorded number of generated trigger signals.

2. The safety system of claim 1 further comprising a signal conditioning block disposed between outputs of said alarm panel and each of said at least one alarm notification device and/or at least one safety activation device.

3. The safety system of claim 1 wherein the output signal from the alarm panel to said at least one alarm notification device and/or at least one safety activation device comprises a digital signal including a digital address for said at least one alarm notification device and/or at least one safety activation device.

4. The safety system of claim 2 wherein a single separate modification device is associated with each alarm notification device and safety activation device and the modification devices are operative to receive signals from the output of the alarm panel adapted to activate its associated alarm notification device or safety activation device and to provide its output to its associated alarm notification device and/or safety activation device.

5. The safety system of claim 2 wherein a separate signal conditioning device is associated with each output of the alarm panel so as to provide signal conditioning in the communication path between each output of the alarm panel and at least one alarm notification device and/or at least one safety activation device.

6. The safety system of claim 1 wherein said timer has an input for a user to select the predetermined amount of a time delay.

7. The safety system of claim 1 wherein said timer further comprises a user interface button operative to initiate said timer upon activation.

8. The safety system of claim 1 further comprising a visual indicator active during said predetermined period of time.

9. A process for testing a safety system comprising input devices for ambient conditions which generate triggering outputs through a communication path to alarm notification and/or safety activation output devices when potentially dangerous conditions are detected, said process comprising:

disconnecting the communication path to the output devices for a predetermined time by user activation of a timer;

activating said input devices to generate triggering outputs during the time the said communication path is disconnected from the output devices; and detecting and recording the number of said triggering outputs occurring during the time the communication path is disconnected from the output devices at the inputs to said output devices to test the integrity of said system from the input devices to the output devices using the recorded number of generated trigger signals.

10. The process of claim 9 wherein said timer is activated by a user interface button.

11. The process of claim 9 further comprising adjusting said predetermined time.

* * * * *